US007043189B2

(12) United States Patent
Blair et al.

(10) Patent No.: US 7,043,189 B2
(45) Date of Patent: May 9, 2006

(54) METHODS AND DEVICES FOR MOVING WASTE TONER WITHIN AN IMAGE FORMING DEVICE

(75) Inventors: Bryan Michael Blair, Lexington, KY (US); Darin Michael Gettelfinger, Lexington, KY (US); Charles Robert Dunn, II, Georgetown, KY (US); Paul Douglas Horrall, Lexington, KY (US); James Philip Harden, Lexington, KY (US); Billy Joe Jones, Winchester, KY (US); Alexander Douglas Meade, Lexington, KY (US); Stacy Marie Pargett, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/894,686

(22) Filed: Jul. 20, 2004

(65) Prior Publication Data

US 2006/0018690 A1 Jan. 26, 2006

(51) Int. Cl.
*G03G 21/00* (2006.01)

(52) U.S. Cl. ..... 399/358

(58) Field of Classification Search ..... 399/350
See application file for complete search history.

(56) References Cited

U.S. PATENT DOCUMENTS

| | | | | |
|---|---|---|---|---|
| 4,685,798 | A | 8/1987 | Matsumoto | |
| 4,982,240 | A | 1/1991 | Nakano | |
| 5,229,826 | A | 7/1993 | Sonnenberg | |
| 6,463,254 | B1 | 10/2002 | Maul et al. | |
| 6,832,067 | B1 * | 12/2004 | Kubo | 399/350 |

* cited by examiner

*Primary Examiner*—Quana Grainger
(74) *Attorney, Agent, or Firm*—Coats & Bennett, PLLC

(57) ABSTRACT

A cleaning apparatus in a waste toner removal system of an image forming device includes a waste toner moving device that is movably mounted in a waste toner housing. The housing has an inlet where waste toner enters the housing. The toner moving device is movable between a first position and a second position to displace accumulated toner within the housing. The toner moving device is spring-biased toward the first position. A rotating actuator displaces the toner moving device from the first position to the second position to move the toner in the housing away from the inlet. The toner moving device is also self-cleaning via vibration and impact movements.

35 Claims, 7 Drawing Sheets

METHODS AND DEVICES FOR MOVING WASTE TONER WITHIN AN IMAGE FORMING DEVICE

BACKGROUND

During the image forming process, toner is transferred from toner carrying members to print or copy media. Inefficiencies in the transfer process cause residual toner to remain on the toner carrying members or other transport members, such as transport belts, intermediate transfer belts/drums, and photoconductive members. Residual toner may also be created during registration, color calibration, paper jams, and over-print situations. This residual toner should be cleaned before it affects the quality of subsequent images. The residual or waste toner is commonly removed by a blade or other means and the removed toner is stored in a waste toner housing.

The effectiveness of a waste toner cleaner can be limited by back-pressure exerted at the cleaner throat by waste toner that accumulates in the housing. The cleaner throat is the area between a waste toner cleaner blade, a waste toner cleaner seal, and the surface being cleaned by the blade. Toner that is removed by the blade enters a waste toner cleaner housing at the throat. Back-pressure in this throat area may be generated by the sheer weight of the accumulated toner and may also be imparted through the accumulated toner pile by other devices in the housing, such as an auger that operates to move the waste toner to a location away from the cleaner blade. In any case, back pressure at the entrance to the housing can compromise the effectiveness of the cleaner by preventing newly cleaned waste toner from flowing into the cleaner housing.

SUMMARY

The present invention is directed to a cleaning apparatus applicable in a waste toner removal system for an image forming device. The invention includes a waste toner moving device that is movably mounted in a waste toner housing. The housing has an inlet where a cleaning blade is attached to remove toner from a transfer body. Waste toner that is removed by the blade enters the housing through the inlet. The waste toner housing includes an auger that rotates to move the toner within the housing. A drive gear is coupled to the auger to rotate the auger from a drive source. The toner moving device is pivotally mounted in the housing and is movable between a first position and a second position. The toner moving device is spring-biased toward the first position. A cam coupled to the gear displaces the toner moving device from the first position to the second position to move the toner in the housing away from the inlet and toward the auger. A portion of the toner moving device also contacts the auger when the toner moving device is in the first position. This contact between the toner moving device and the auger causes a vibration that inhibits the accumulation of toner on the toner moving device.

DETAILED DESCRIPTION

Figure 1:
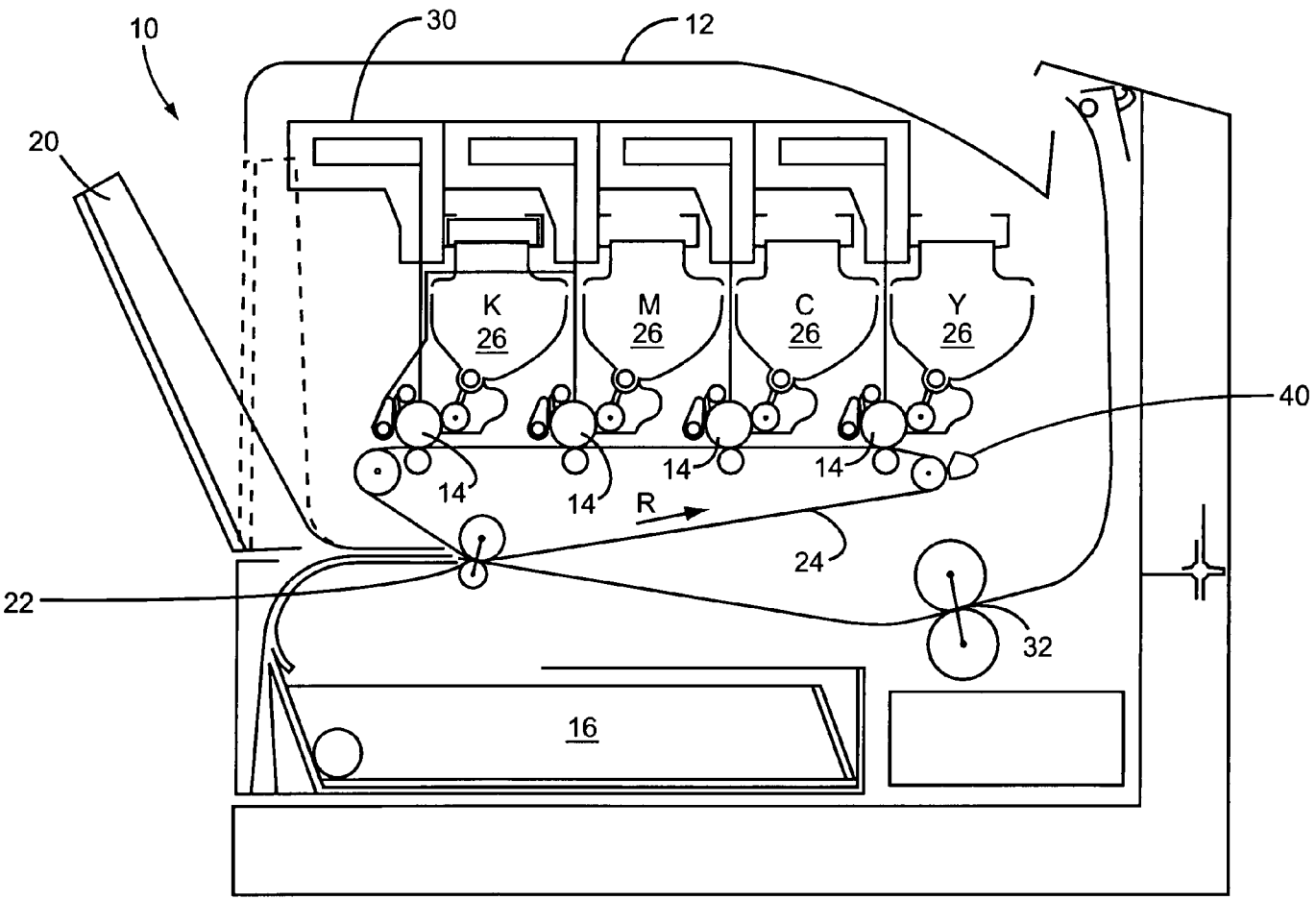
FIG. 1 is a functional block diagram of an image forming apparatus according to one embodiment of the present invention.

The present invention is directed to a cleaner apparatus for a waste toner system within an image forming device as generally illustrated in FIG. 1. FIG. 1 depicts a representative image forming device, indicated generally by the numeral 10. The image forming device 10 comprises a main media sheet stack 16. Media sheets may also be introduced through a manual input 20. The term "image forming device" and the like is used generally herein as a device that produces images on a media sheet. Examples include but are not limited to a laser printer, ink-jet printer, fax machine, copier, and a multi-functional machine. Examples of an image forming device include Model Nos. C750 and C752 available from Lexmark International, Inc. of Lexington, Ky.

Within the image forming apparatus body 12, the image forming apparatus 10 includes a plurality of removable image formation cartridges 26, each with a similar construction but distinguished by the toner color contained therein. In one embodiment, the apparatus 10 includes a black cartridge (K), a magenta cartridge (M), a cyan cartridge (C), and a yellow cartridge (Y). Each cartridge 26 forms an individual monocolor image that is combined in layered fashion with images from the other cartridges to create the final multi-colored image. The image forming apparatus further includes an intermediate transfer mechanism (ITM) belt 24, one or more imaging devices 30, a fuser 32, and a waste toner cleaner 40 as well as various rollers, actuators, sensors, optics, and electronics (not shown) as are conventionally known in the image forming apparatus arts, and which are not further explicated herein.

The internal components of removable image formation cartridges 26 are not specifically identified in FIG. 1, but are briefly described. Each image formation cartridge 26 is a removable cartridge that may include a reservoir holding a supply of toner, a developer roller for applying toner to develop a latent image on a photoconductive drum, and a photoconductive (PC) drum 14, which may comprise, for example, an aluminum hollow-core drum coated with one or more layers of light-sensitive organic photoconductive materials. The image formation cartridge 26 may additionally include various rollers, paddles, augers and blades, as well known in the art. Note that this description is representative only—various image formation devices may organize these components into a plurality of cartridges.

The operation of the image forming apparatus 10 is conventionally known. Upon command from control electronics, a single media sheet is "picked," or selected, from either the primary media stack 16 or the manual input 20. Regardless of its source, the media sheet is transported to transfer location 22 to receive a toner image from the ITM belt 24. The ITM belt 24 is endless and rotates in the direction indicated by arrow R around a series of rollers adjacent to the PC drums 14 of the respective image formation cartridges 26. Toner is deposited from each PC drum 14 as needed to create a full color image on the ITM belt 24. The ITM belt 24 and each PC drum 14 are synchronized so that the toner from each PC drum 14 precisely aligns on the ITM belt during a single pass.

The media sheet may receive an electrostatic charge before contacting the ITM belt 24 at the transfer location 22 to assist in attracting the toner from the belt 24. The sheet and attached toner next travel through a fuser 32 having a pair of rollers and a heating element that heats and fuses the toner to the sheet. The paper with fused image is then transported out of the printer body 12 for receipt by a user.

In the image forming apparatus shown in FIG. 1, four image formation cartridges 26 are arrayed along the ITM belt 24. A full color image is formed on the ITM belt and the color image is subsequently transferred to a print media sheet at a secondary transfer location 22. Other devices may use an intermediate transfer drum instead of belt 24. In other conventional image forming devices, print media sheets are transported by a transfer belt similar in configuration to belt 24, but a full color image is formed directly on the media sheet by successively transferring images from the four respective image formation cartridges 26 (cyan, yellow, magenta, and optionally black) onto the media sheet. In either of these configurations, residual toner that remains on the belt 24 following the image formation process is removed by a waste toner cleaner 40. Residual toner that remains on belt 24 following color calibration and/or paper registration processes must also be cleaned by the waste toner cleaner 40.

Figure 2:
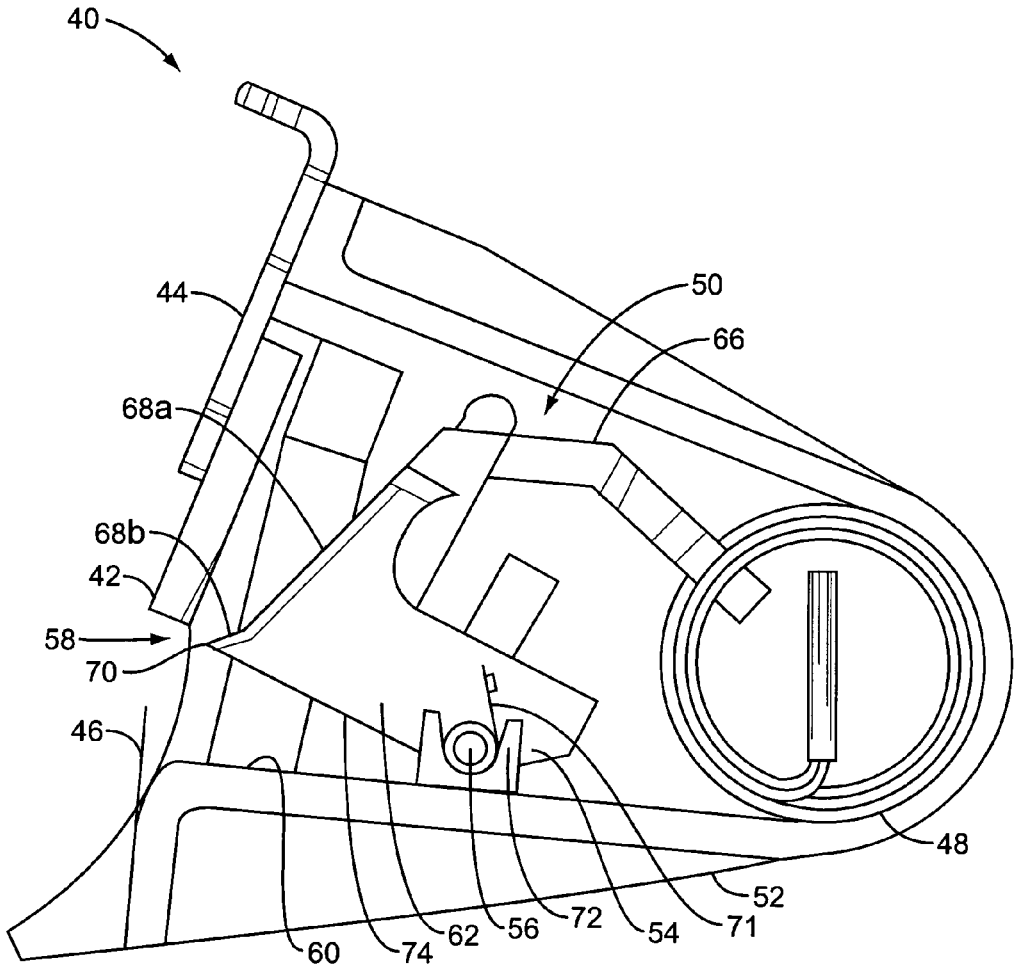
FIG. 2 illustrates a side cross-sectional view of the waste toner cleaner according to one embodiment of the present invention.
Figure 3:
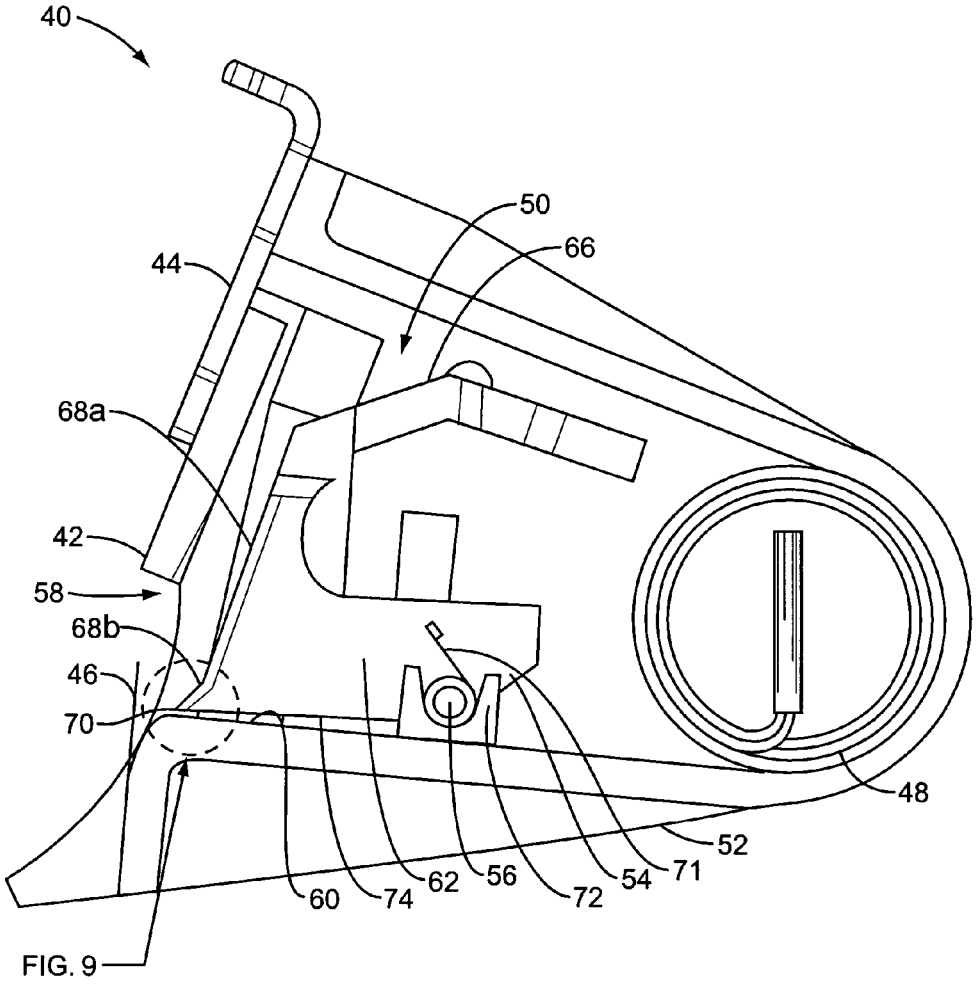
FIG. 3 illustrates a side cross-sectional view of the waste toner cleaner according to one embodiment of the present invention.

FIGS. 2 and 3 illustrate a side cross-sectional view of the waste toner cleaner 40. The waste toner cleaner 40 is comprised of a blade 42, blade bracket 44, lower seal 46, auger 48, and cleaner apparatus 50 all contained within or coupled to a housing 52. The waste toner cleaner 40 is positioned so that cleaner blade 42 is in contact with a surface to be cleaned. The surface to be cleaned may be part of a number of different electrophotographic components, including intermediate transfer member belts, photoconductor belts, photoconductor drums, and media transport belts. In the orientation shown in FIGS. 2 and 3, the surface to be cleaned moves past the waste toner cleaner 40 at the inlet to the housing 58. As the surface to be cleaned moves past the waste toner cleaner 40, the cleaner blade 42 removes toner from that surface. The removed toner is guided at inlet 58 into the interior of the housing 52 by lower seal 46. The removed toner accumulates in the housing on floor 60, which is sloped gradually downward and rearward away from the inlet 58. The auger 48 rotates to transport the waste toner to a separate part of housing 52 or to a remote storage container (not shown). In the embodiments shown in the Figures, the auger 48 is depicted as a coiled wire, although other conveyors known to those skilled in the art, including screws or other equivalent devices, may be used. The auger 48 is rotatively driven by a gear 76 (see FIGS. 4 through 8) that is driven by an external drive source (not shown).

The cleaner apparatus 50 comprises a toner moving member 54 that is pivotally attached to the housing 52 at pivot point 56. The toner moving member 54 is depicted in FIG. 2 in a first position and is depicted in FIG. 3 in a second position. These positions are described in further detail below. The toner moving member 54 is a generally elongate structure (see also FIG. 4) that spans much of the width of the cleaner housing 52 and has a generally inverted-L shape cross section. The upper portion of the inverted-L shape is defined by a shelf 66, while the lower portion of the inverted-L shape is defined by a chopping wall 68. The chopping wall 68 may advantageously be subdivided into upper 68*a* and lower 68*b* sections. The toner moving member 54 is supported at its ends by side walls 62. Protrusions 64 extending from side walls 62 are engaged by corresponding pivot supports 72 located within the housing 52. In one embodiment, protrusions 64 are embodied as dowel pins that are inserted into holes in the side walls 62. In another embodiment, the protrusions 64 are an integral part of the toner moving member body 54. When supported in this manner, pivot point 56 coincides with the center axis of protrusions 64.

The toner moving member 54 is pivotable between two positions about pivot point 56. In FIG. 2, toner moving member 54 is in a first position where the leading edge 70 of the lower section 68*b* of chopping wall 68 is spaced away from the floor 60 of housing 52. By comparison, the toner moving member 54 shown in FIG. 3 is in a second position where the leading edge 70 of the lower section 68*b* of chopping wall 68 is closer to the floor 60 of housing 52. In one embodiment, the leading edge 70 actually contacts the floor 60 in the second position. In one embodiment, the leading edge 70 is adjacent to the floor 60 in the second position. In another embodiment, the leading edge 70 is spaced away from the floor 60 in the second position, but is still in closer proximity to the floor than in the first position. In one embodiment, the toner moving member 54 is biased by a spring 71 or other resilient member towards the first position.

Pivot point 56 is positioned vertically above the floor 60 of housing 52 so that as the toner moving member 54 travels between the first and second positions, the leading edge 70 is contactable with the floor 60. In one embodiment, the lower edges 74 of side walls 62 remain out of contact with the floor 60 so as not to impede the motion of the toner moving member 54. In one embodiment, the pivot point 56 is positioned at nearly the same vertical height as the leading edge 70 in the second position described above. In other embodiments, the position of pivot point 56 may advantageously be placed at higher points in space, as design constraints permit, to allow the leading edge 70 to pass a horizontal apex and travel away from the inlet 58 and away from blade 42 as the toner moving member 54 approaches the second position. In this latter configuration, the movement of the leading edge 70 will therefore have a horizontal component that will aid in moving waste toner away from the inlet 58 and towards the auger 48.

Figure 9:
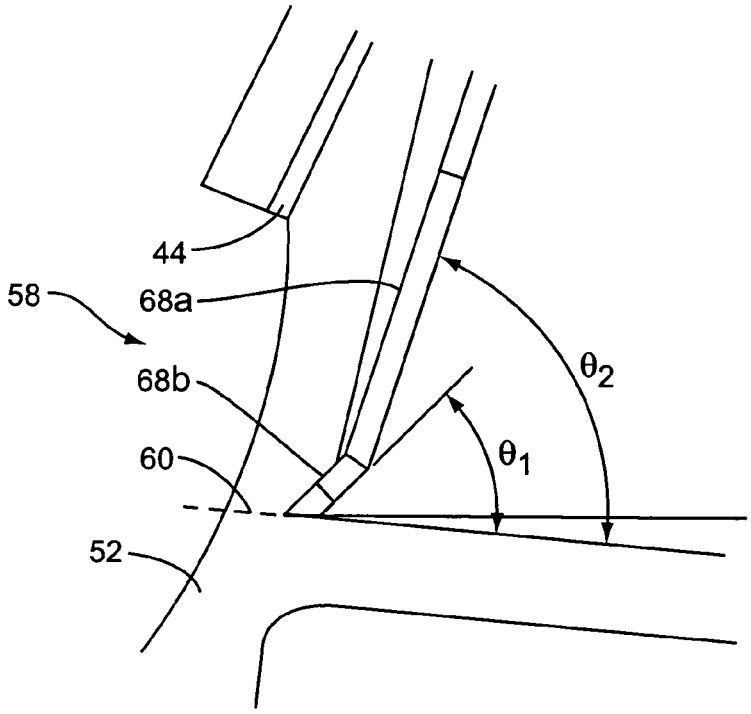
FIG. 9 is a detail view of the chopping wall of the toner moving member according to one embodiment of the present invention.

In addition to using the motion of the leading edge 70 (as just described) to displace waste toner within housing, the shape of the leading edge 70 and chopping wall 68 also advantageously cooperate to displace waste toner away from the blade 42. FIG. 9 shows a detail view of the orientation of the upper 68*a* and lower 68*b* sections of chopping wall 68 relative to the floor 60 of housing 52 when the toner moving member 54 is in the second position (as shown in FIG. 3). As shown in FIG. 9, the upper 68*a* and lower 68*b* sections of the chopping wall 68 are disposed at different angles relative to the floor 60 of housing 52, although both sections 68*a*, 68*b* are tilted away from the inlet 58 and blade 44. The lower section 68*b* is more acutely oriented than the upper section 68*a* relative to the floor 60. In other words, the lower section 68*b* is tilted at an angle $\Theta_1$ relative to floor 60 that is less than the angle $\Theta_2$ at which the upper section 68*a* is tilted. The orientation of the upper 68*a* and lower 68*b* sections aid in directing waste toner away from the inlet in generally the left to right direction in FIG. 9. Thus, the design of the chopping wall 68 moves the toner away from the blade 44 towards the auger 48 and advantageously prevents toner build-up that could cause back-pressure on the blade 44.

If the angle $\Theta_1$ is too small, the lower section 68*b* will compact waste toner against floor 60 instead of displacing the toner away from the inlet. If the angle $\Theta_1$ is too large, the waste toner will remain stagnant on the floor 60 and not move towards the auger 48. The angle $\Theta_1$ is selected to be in the range between about 25° and 65°. In one embodiment, the angle $\Theta_1$ is selected to be in the range between about 40° and 45°. In one specific embodiment, the angle $\Theta_1$ is selected to be 42°.

The angle $\Theta_2$ is less acute than $\Theta_1$ to inhibit adhesion of waste toner to the chopping wall 68. Thus, a more vertical orientation is desirable and the angle $\Theta_2$ is selected to be in the range between about 65° and 90°. In one embodiment, the angle $\Theta_2$ is selected to be in the range between about 75° and 80°. In one specific embodiment, the angle $\Theta_2$ is selected to be 77°.

In one embodiment, the chopping wall 68 does not have upper and lower sections 68*a*, 68*b*, but instead is comprised of a single flat section that is disposed at a fixed angle relative to the floor 60 of housing 52. In another embodiment, the chopping wall 68 is comprised of a curved wall that has a constant radius. In another embodiment, the chopping wall 68 is comprised of a curved wall that has a lower leading portion that is more acutely oriented than an upper portion. A variety of configurations for the chopping wall 68 that incorporate the teachings herein may be employed as will be understood by those skilled in the art.

Figure 4:
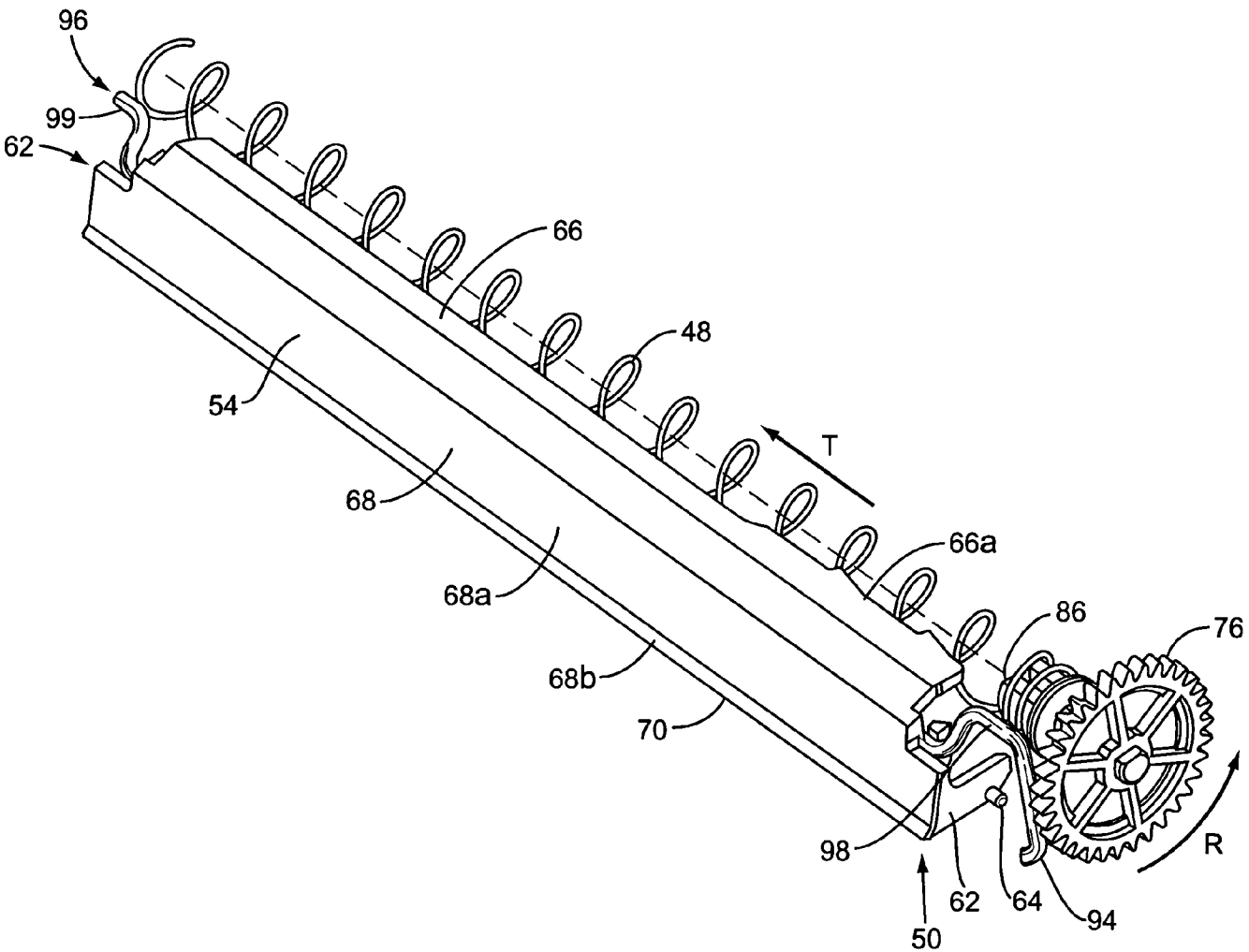
FIG. 4 illustrates a perspective view of the waste toner cleaner according to one embodiment of the present invention.

Referring now to FIG. 4, a perspective view of the cleaner apparatus 50 is provided. As discussed above, the toner moving member 54 includes a reciprocating chopping wall 68 and upper shelf 66. The toner moving member is pivotable about protrusions 64 that extend from the side walls 62. FIG. 4 also shows the auger 48 as a spiraled body adapted to displace waste toner within or from the waste toner housing 52. The waste toner housing 52 and other components of the waste toner cleaner 40 (e.g., blade 44, seal 46) are omitted for clarity. The auger 48 is driven by a drive gear 76 that is rotated by a drive source that is not explicitly shown in the Figures, but is understood by those skilled in the art to be a motor and/or a drive train capable of imparting a rotational force to the waste toner auger 48. The drive gear 76 shown in FIGS. 4 through 8 rotates in a direction indicated by the arrow labeled R. This gear rotation, in turn, rotates the auger so as to displace toner in the direction indicated by the arrow labeled T.

Figure 5:
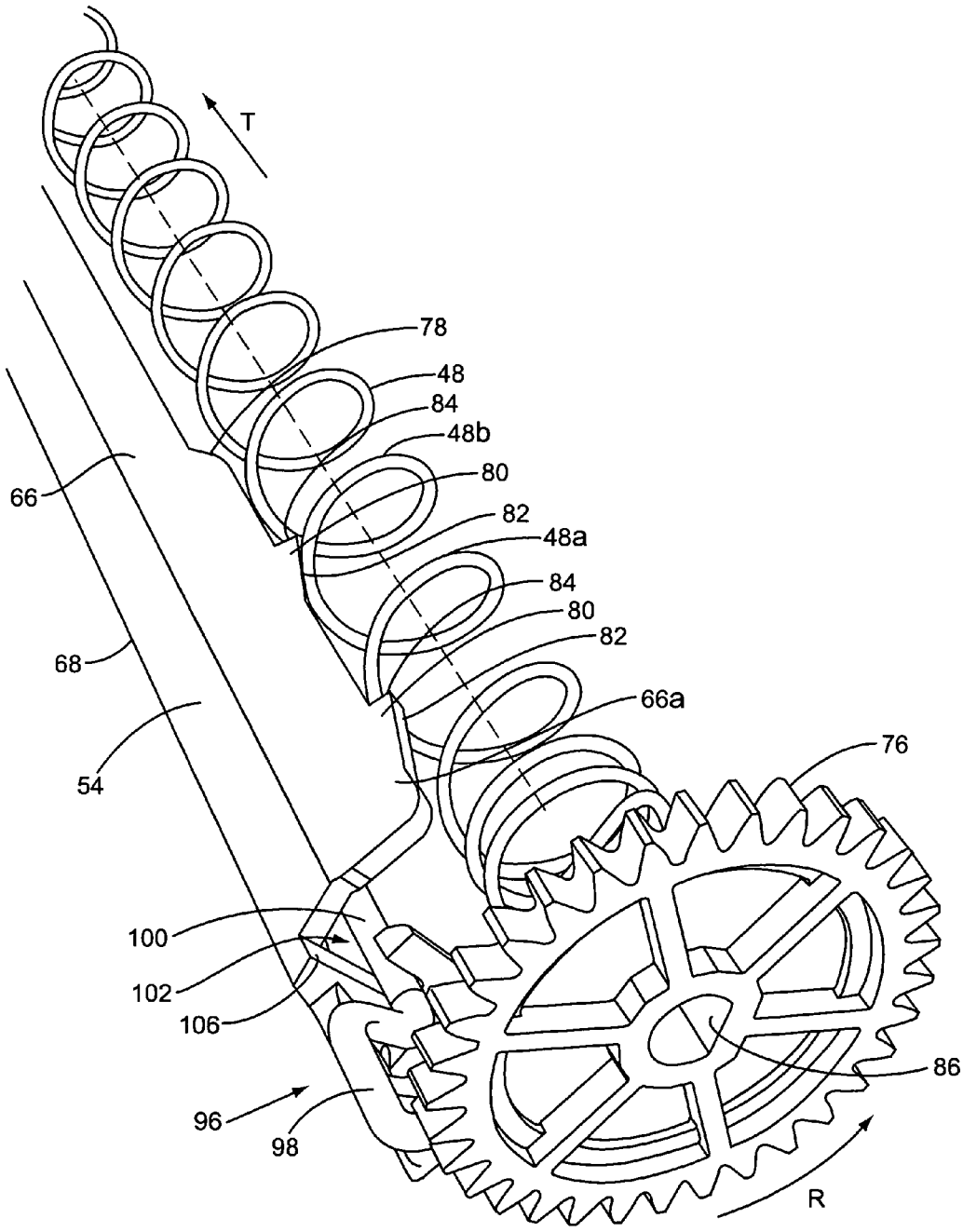
FIG. 5 illustrates a partial detailed perspective view of the waste toner cleaner according to one embodiment of the present invention.

As shown in FIGS. 3, 4, and 5, the upper shelf 66 of toner moving member 54 extends substantially perpendicular from the upper portion 68*a* of the chopping wall 68. The shelf 66 has a contact portion 66*a* that extends a larger distance away from the chopping wall 68 and towards auger 48 than the remainder of the shelf 66. Wall 78 shown in FIG. 5 represents the transition area between the contact portion 66*a* and the remainder of the shelf 66. The contact portion 66*a* advantageously protrudes a sufficient amount as to permit tabs 80 to contact auger 48. As discussed above, the toner moving member 54 is biased toward the first position where the chopping wall 68 is elevated from floor 60 of the waste toner cleaner housing 52. In this first position, the contact portion 66*a* of shelf 66 is placed close to the auger 48.

A plurality of triangular-shaped tabs 80 extend outward from the end of contact portion 66*a* of shelf 66. These tabs 80 extend farther towards the auger 48 than does the contact portion 66*a*. As a result of this protrusion, the individual turns (e.g., 48*a* and 48*b* shown in FIG. 5) of the auger 48 periodically come into contact with the tabs 80 as the auger rotates. As discussed above, the auger 48 tends to displace waste toner in the direction indicated by the arrow T. Consequently, the individual turns of the auger 48 also tend to move in this direction. The tabs 80 are generally triangle-shaped with the leading edge 82 (i.e., the edge closest to drive gear 76) having a more gradual slope than the trailing edge 84. As the auger 48 rotates, the individual auger turns 48*a*, 48*b* initially contact the tabs 80 at the leading edge 82. The motion of the auger 48 in sliding contact with the tabs 80 vibrates the toner moving member 54. The interference between the tabs 80 and the auger 48 also creates a small displacing force. This small displacing force tends to pivot the toner moving member 54 against the bias of spring 71 a small amount out of the first position in the direction of the second position. In essence, the auger 48 displaces the toner moving member by the tabs 80 until the individual auger turns 48*a*, 48*b* move past the tabs 80. Once the auger turns 48*a*, 48*b* come out of contact with the tabs 80, the toner moving member 54 returns to the first position under the influence of spring 71. The slope of the trailing edge 84 of tabs 80 is sharp to permit the auger 48 to quickly lose contact with the tabs 80 and allow the toner moving member 54 to rapidly return to the first position. This rapid movement imparts a jarring motion that tends to loosen any waste toner that may accumulate on the toner moving member 54. The jarring motion may also be of a sufficient magnitude to vibrate the remainder of the housing 52, housing blade 44, and lower seal 46 to loosen accumulated waste toner.

Figure 6:
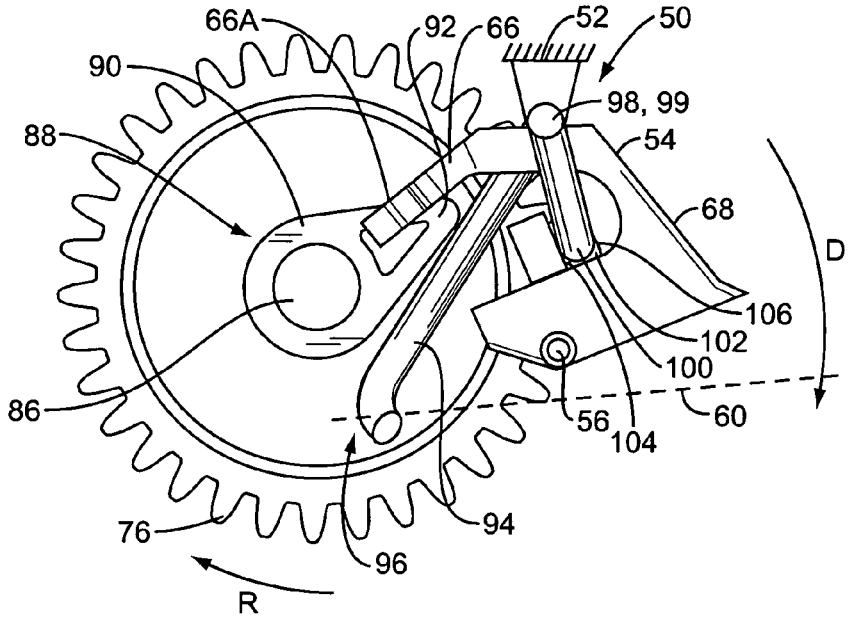
FIG. 6 is a partial side view and the first in a sequence showing the actuator movement according to one embodiment of the present invention.
Figure 7:
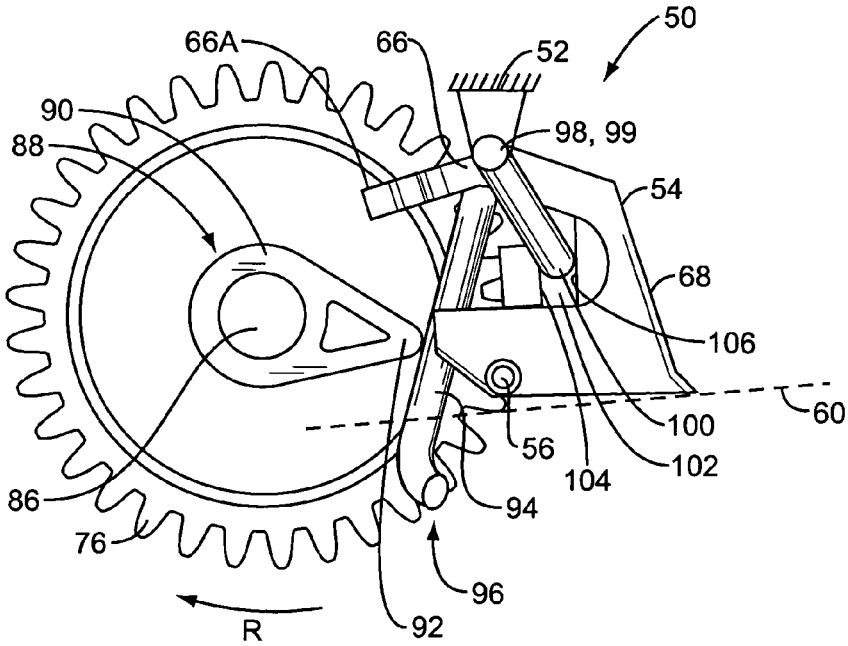
FIG. 7 is a partial side view and the second in a sequence showing the actuator movement according to one embodiment of the present invention.
Figure 8:
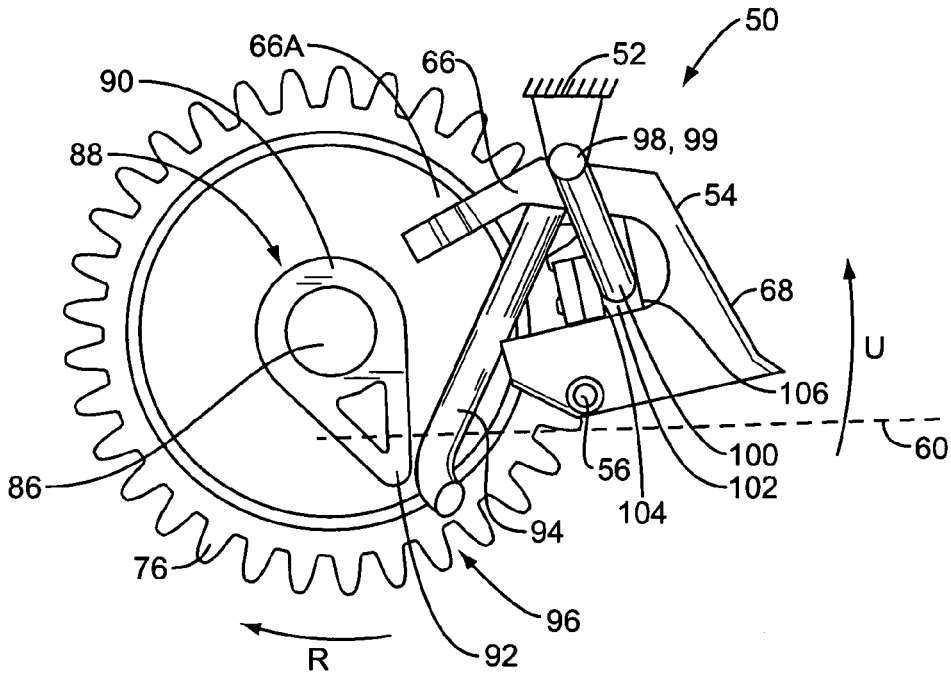
FIG. 8 is a partial side view and the last in a sequence showing the actuator movement according to one embodiment of the present invention.

Referring still to FIGS. 4 and 5 with additional attention now to FIGS. 6 through 8, the drive gear 76 is coupled to the auger 48 by a shaft 86. For clarity, FIGS. 6–8 show only the drive mechanism that operates to deflect the waste toner cleaner apparatus 50 between the first (up) position and the second (down) position. The shaft 86 protrudes through the drive gear 76 and through the waste toner cleaner housing 52 so that the auger 48 can be driven by an external drive source (not shown). An actuator, depicted generally by the number 88, is also coupled to the shaft 86. In the embodiment shown in the Figures, actuator 88 is advantageously embodied as a cam 90 that has a single eccentric lobe 92 that causes the toner moving member 54 to deflect downward from the first position to the second position as described above. Once per revolution of shaft 86 (and hence, gear 76), the cam lobe 92 comes into contact and moves a deflecting arm 94 of pivot linkage, which is indicated generally by reference numeral 96. In one embodiment, the pivot linkage 96 is implemented as a bail, or a twisted wire member with the shape shown in the Figures. The pivot linkage 96 is mounted to the waste toner housing 52 at horizontal mounting segments 98 and 99. The cam lobe 92 contacts the deflecting arm 94, which causes the pivot linkage to pivot about horizontal segments 98, 99. As the deflecting arm 94 pivots, a lower urging segment 100 pivots about horizontal segments 98, 99 in the same rotational direction as the deflecting arm 94.

The lower urging segment 100 rests within a channel 102 in the toner moving member 54 that is bounded on opposite sides by walls 104, 106. As the deflecting arm is moved by cam lobe 92, the urging segment 100 tends to push on wall 106. The point of contact between urging segment 100 and wall 106 is above pivot point 56. Consequently, toner moving member 54 rotates in a direction indicated by the arrow D shown in FIG. 6. As cam 90 continues to rotate while contacting the deflecting arm 94, the pivot linkage 96 continues to rotate about horizontal segments 98, 99. FIG. 7 shows the cleaner apparatus 50, including toner moving member 54 and pivot linkage 96 rotated into the second, downward position described above. As the cam 90 continues to rotate out of contact with the deflecting arm 94 as shown in FIG. 8, the bias spring 71 (not shown in FIGS. 6–8) tends to return the cleaner apparatus 50 to the first position. In this manner, the toner moving member 54 deflects between the first and second positions to displace toner along the waste toner housing floor 60.

In one embodiment, the pivot linkage 96 is a resilient drive bail that is rigid enough to impart the urging forces described. However, the resilient nature of the pivot linkage 96 tends to buffer impact forces that may otherwise be transmitted to the toner moving member 54 by the actuator 88. Design constraints will invariably determine the shape and configuration of the actuator 88, drive linkage 96, and toner moving member 54. Thus, the design shown in the Figures is one particular embodiment. Other designs may capture the essence of the teachings herein. For instance, in one embodiment, it may be desirable to have the actuator 88 directly contact the toner moving member 54 in order to deflect the toner moving member 54 between the first and second positions. In addition, a spring 71 has been shown in FIGS. 2 and 3 as providing a biasing force tending to hold the waste toner cleaner apparatus 50 in the first position. In another embodiment, a separate spring may be used to bias the drive linkage 96. Furthermore, a cam actuator 90 has been shown as providing the initiation force that drives the cleaner apparatus 50 toward the second position. In other embodiments, a cam with multiple lobes or a rotating body with one or more recesses may be used to provide the impetus that deflects the cleaner apparatus 50 as described. Alternatively, the cleaner apparatus 50 may be spring biased toward the second position while an actuator permits periodic transitions to the first position.

The present invention may be carried out in other specific ways than those herein set forth without departing from the scope and essential characteristics of the invention. For instance, the embodiments described have been depicted in use with a waste toner cleaner 40 that uses a blade 44. Other cleaners known by those skilled in the art, such as foam or brush rollers can also be employed. Furthermore, while the embodiments discussed have been described in the context of a waste toner mover 54 that pivots about point 56, may be desirable to implement a linearly actuating waste toner mover. The waste toner mover 54 may be incorporated in a variety of image forming devices including, for example, printers, fax machines, copiers, and multi-functional machines including vertical and horizontal architectures as are known in the art of electrophotographic reproduction. The present embodiments are, therefore, to be considered in all respects as illustrative and not restrictive, and all changes coming within the meaning and equivalency range of the appended claims are intended to be embraced therein.

What is claimed is:

1. A device to remove toner from a transfer body in an image forming apparatus comprising:

a housing having an inlet;

a blade attached to the housing to remove toner from the transfer body, the removed toner entering the housing through the inlet;

an auger to rotate and move the toner within the housing;

a rotatable drive gear coupled to the auger to rotate the auger;

a toner moving device pivotally mounted in the housing, the toner moving device vertically movable in an up-and-down direction; and a cam coupled to the gear, the cam displacing the toner moving device between a first position and a second position to move the toner in the housing away from the inlet toward the auger.

2. The device of claim 1 wherein in the first position, the toner moving device contacts the auger, the toner moving device vibrating as the auger rotates.

3. The device of claim 1 wherein the toner moving device is biased to the first position by a resilient member.

4. The device of claim 1, wherein the cam is coupled to the gear such that at least once per revolution of the drive gear, the cam displaces the toner moving device between the first and second positions.

5. A device to remove toner from a transfer body in an image forming apparatus comprising:

a housing having an inlet and a storage location distanced from the inlet;

a blade attached to the housing to remove toner from the transfer body, the removed toner entering the housing through the inlet;

a drive shaft that is rotatably mounted to the housing and rotatable by a drive source;

a toner moving device movably mounted in the housing, the toner moving device movable in a vertical direction; and an actuator coupled to the drive shaft, the actuator displacing the toner moving device between a first position and a second position to move the toner in the housing away from the inlet toward the storage location.

6. The device of claim 5 wherein the toner moving device comprises a chopping wall having a lower leading edge, the leading edge being elevated above a floor of the housing when the toner moving device is in the first position and the leading edge being in closer proximity to the floor relative to first position when the toner moving device is in the second position.

7. The device of claim 6 wherein the leading edge contacts the floor when the toner moving device is in the second position.

8. The device of claim 6 wherein the chopping wall is tilted away from the inlet when the toner moving device is in the second position.

9. The device of claim 5 wherein the toner moving device is spring biased to the first position.

10. The device of claim 5, wherein the actuator is coupled to the drive shaft such that at least once per revolution of the drive shaft, the cam displaces the toner moving device between the first and second positions.

11. A device to move toner comprising:

a housing having an inlet and a storage location distanced from the inlet with a floor extending between the inlet and the storage location; and a toner moving member movably mounted in the housing, the toner moving member having a reciprocating wall with a leading edge, the reciprocating wall movable between a first position and a second position such that the leading edge is spaced above the floor in the first position and the leading edge is adjacent the floor in the second position, the reciprocating wall being tilted away from the inlet when the reciprocating wall is in the second position.

12. The device of claim 11 wherein the toner moving member is pivotally mounted within the housing about a pivot axis that is positioned vertically above the floor.

13. The device of claim 11 wherein the leading edge travels along an arcuate path between the first and second positions.

14. The device of claim 11 wherein when the leading edge travels between the first and second positions, the leading edge is at least partially moving away from the inlet prior to contacting the floor.

15. The device of claim 11 wherein the leading edge contacts the floor when the reciprocating wall is in the second position.

16. The device of claim 11 wherein when the reciprocating wall is in the second position the reciprocating wall is tilted away from the inlet at an angle between about 30 degrees and about 60 degrees relative to the floor.

17. The device of claim 11 wherein the reciprocating wall comprises an upper portion and a lower portion, the lower portion having the leading edge, and when the reciprocating wall is in the second position, the lower portion is tilted at an angle between about 30 degrees and about 60 degrees relative to the floor.

18. The device of claim 17 wherein when the reciprocating wall is in the second position, the upper portion is tilted away from the inlet at an angle between about 70 degrees and about 90 degrees relative to the floor.

19. A device to move toner comprising:

a housing;

an auger positioned within the housing to rotate and move the toner within the housing; and a toner moving device pivotally positioned within the housing, the toner moving device contacting the auger and rotation of the auger causes the toner moving device to move between a first position with a leading edge above a floor of the housing and a second position with the leading edge adjacent to the floor to move the toner in the housing toward the auger.

20. The device of claim 19 further comprising an actuator coupled to the auger, the actuator causing the toner moving device to pivot between the first position and the second position.

21. The device of claim 20 wherein the actuator is a cam having an eccentric lobe that contacts a portion of the toner moving device causing the toner moving device to pivot between the first position and the second position.

22. The device of claim 21 wherein the eccentric cam lobe contacts a drive bail on the toner moving device causing the toner moving device to pivot between the first position and the second position.

23. The device of claim 19 wherein the contact between the toner moving device and the auger causes the toner moving device to vibrate to inhibit the accumulation of toner on the toner moving device.

24. The device of claim 19 wherein the toner moving device is pivotally mounted in the housing.

25. The device of claim 19 wherein the toner moving device is biased toward the first position by a resilient member.

26. The device of claim 19 wherein the toner moving device contacts the auger when the toner moving device is in the first position.

27. A method of moving toner comprising the steps of:

removing toner from a transfer body and directing the toner into an inlet of a housing;

rotating an auger within the housing and moving the toner;

contacting a toner moving device against the rotating auger causing the toner moving device to pivot between a first vertical position and a second vertical position; and moving the toner moving device between the first position and a second position and moving the toner in the housing away from the inlet toward the auger.

28. The method of claim 27 further comprising biasing the toner moving device toward the first position.

29. The method of claim 27 further comprising vibrating the toner moving device while the toner moving device is in the first position.

30. The method of claim 27 further comprising vibrating the housing while the toner moving device is in the first position.

31. A method of preventing back-pressure on a cleaning blade caused by the accumulation of toner in a waste toner housing comprising the steps of:

removing toner from a transfer body and directing the toner into an inlet of a housing;

pivoting a toner moving device between a first position and a second position to move toner away from the inlet; and vibrating the toner moving device to inhibit the buildup of toner on the toner moving device; and pivoting the toner moving device about a pivot axis that is located above a floor of the housing on which the toner accumulates; and periodically rotating the toner moving device about the pivot axis between the first position where the toner moving device is spaced above the floor and the second position where the toner moving device is in closer proximity to the floor relative to the first position.

32. The method of claim 31 further comprising:

moving toner within the housing by rotating an auger; and vibrating the toner moving device by positioning the toner moving device in contact with the auger.

33. The method of claim 32 further comprising biasing the toner moving device into contact with the auger when the toner moving device is in the first position.

34. A device to remove toner from a surface:

a housing having an inlet;

a blade attached to the housing to remove toner from the surface, the removed toner entering the housing through the inlet;

an inlet seal to guide removed toner into the housing;

a floor positioned below the inlet onto which the removed toner falls;

an auger to rotate and move the toner within the housing;

a rotatable drive gear coupled to the auger to rotate the auger;

a toner moving device pivotally mounted in the housing, the toner moving device movable between a first position and a second position;

a resilient spring member to bias the toner moving member towards the first position; and a cam coupled to the gear, the cam displacing the toner moving device from the first position to the second position to move the toner on the floor of the housing away from the inlet toward the auger, the toner moving device further comprising:

a chopping wall having a having a lower leading edge and an upper shelf, the leading edge being elevated above the floor of the housing when the toner moving device is in the first position and the leading edge being in closer proximity to the floor relative to first position when the toner moving device is in the second position, the upper shelf contacting the auger, and the toner moving device vibrating as the auger rotates.

35. The device of claim 34 wherein the device is positioned to remove toner from a moving surface in an image forming apparatus.

* * * * *